US009060219B2

(12) United States Patent
Guenther

(10) Patent No.: US 9,060,219 B2
(45) **Date of Patent: *Jun. 16, 2015**

(54) LOUDSPEAKERS AND SYSTEMS

(71) Applicant: DR. G LICENSING, LLC, Reno, NV (US)

(72) Inventor: Godehard A. Guenther, Reno, NV (US)

(73) Assignee: DR. G LICENSING, LLC, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/967,039

(22) Filed: Aug. 14, 2013

(65) Prior Publication Data

US 2013/0329935 A1 Dec. 12, 2013

Related U.S. Application Data

(63) Continuation of application No. 12/693,982, filed on Jan. 26, 2010, now Pat. No. 8,526,660, which is a continuation of application No. 11/223,214, filed on Sep. 9, 2005, now Pat. No. 7,653,208.

(60) Provisional application No. 60/608,755, filed on Sep. 9, 2004.

(51) Int. Cl.

| | |
|---|---|
| ***H04R 1/02*** | (2006.01) |
| ***H04R 1/28*** | (2006.01) |
| *H04R 9/06* | (2006.01) |

(52) U.S. Cl.

CPC ..... *H04R 1/02* (2013.01); *H04R 1/2834* (2013.01); *H04R 9/06* (2013.01); *H04R 2420/07* (2013.01)

(58) Field of Classification Search

CPC .. H01F 2007/1676; H04R 1/02; H04R 1/025; H04R 1/12; H04R 1/22; H04R 1/24; H04R 1/26; H04R 1/30; H04R 1/2834; H04R 7/045; H04R 7/12; H04R 7/16; H04R 7/18; H04R 7/20; H04R 7/122; H04R 7/127; H04R 9/00; H04R 9/02; H04R 9/025; H04R 9/043; H04R 9/045; H04R 9/06; H04R 9/063; H04R 9/066; H04R 17/00; H04R 2209/022; H04R 23/02; H04R 2307/207; H04R 2400/03; H04R 2499/15; H04R 31/006

USPC ..... 381/150, 152, 186, 342, 386, 398, 422, 381/431; 181/144, 148

See application file for complete search history.

(56) References Cited

U.S. PATENT DOCUMENTS

| | | | |
|---|---|---|---|
| 2,551,447 | A | 5/1951 | Marquis |
| 2,582,130 | A | 1/1952 | Johnson |

(Continued)

FOREIGN PATENT DOCUMENTS

| | | | |
|---|---|---|---|
| CN | 2140121 | Y | 8/1993 |
| CN | 1369190 | A | 9/2002 |

(Continued)

OTHER PUBLICATIONS

International Search Report and Written Opinion for Application No. PCT/US2013/57513 issued Nov. 1, 2013. (20 pages).

(Continued)

*Primary Examiner* — Brian Ensey

(74) *Attorney, Agent, or Firm* — Nutter McClennen & Fish LLP; David J. Powsner

(57) ABSTRACT

The invention provides, in one aspect, a loudspeaker that has electrodynamically-driven piston mounted in one external wall and that has movable panels in one or more other external walls. Those panels are air-coupled to the piston, e.g., via air within the enclosure, such that vibrational motion of the piston causes the vibration of the panels, thereby, improving the overall air coupling of the piston to the external environment, e.g., the listening room. Further aspects of the invention provide an improved driver for use, e.g, in the aforementioned loudspeaker. The driver comprises a three-part piston having first and second diaphragms coupled back-to-back with one another and having a voice coil face-mounted (or front-mounted) within the second diaphragm.

12 Claims, 7 Drawing Sheets

(56) References Cited

U.S. PATENT DOCUMENTS 2,769,942 A 11/1956 Hassan
3,067,366 A 12/1962 Hofman
3,340,604 A 9/1967 Parain
3,838,216 A 9/1974 Watkins
3,910,374 A 10/1975 Holehouse
3,912,866 A 10/1975 Fox
3,948,346 A 4/1976 Schindler
3,952,159 A 4/1976 Schott
3,979,566 A 9/1976 Willy
3,984,346 A 10/1976 Gilliland
4,005,278 A 1/1977 Gorike
4,064,966 A 12/1977 Burton
4,076,097 A 2/1978 Clarke
4,122,315 A 10/1978 Schroeder et al.
4,151,379 A 4/1979 Ashworth
4,201,886 A 5/1980 Nagel
4,220,832 A 9/1980 Nagel
4,300,022 A 11/1981 Hastings-James et al.
4,310,849 A 1/1982 Glass
4,379,951 A 4/1983 Gabr
4,401,857 A 8/1983 Morikawa
4,419,770 A 12/1983 Yagi et al.
4,440,259 A 4/1984 Strohbeen
4,472,604 A 9/1984 Nakamura et al.
4,477,699 A 10/1984 Wada et al.
4,492,826 A 1/1985 Chiu
4,552,242 A 11/1985 Kashiwabara
4,565,905 A 1/1986 Nation
4,577,069 A 3/1986 Keezer
4,591,667 A 5/1986 Hino et al.
4,628,154 A 12/1986 Kort
4,726,444 A 2/1988 Iida et al.
4,737,992 A 4/1988 Latham-Brown et al.
4,783,824 A 11/1988 Kobayashi
4,799,264 A 1/1989 Plummer
4,821,331 A 4/1989 Murayama et al.
4,965,837 A 10/1990 Murayama et al.
4,977,975 A 12/1990 Lazzeroni et al.
5,008,945 A 4/1991 Murayama et al.
5,014,323 A 5/1991 Markow et al.
5,027,412 A 6/1991 Hayashi et al.
5,040,221 A 8/1991 Edwards et al.
5,070,530 A 12/1991 Grodinsky et al.
5,115,884 A 5/1992 Falco
5,143,169 A 9/1992 Ziegenberg et al.
5,155,578 A 10/1992 Lim et al.
5,249,236 A 9/1993 Sakamoto
5,321,756 A 6/1994 Patterson, Jr. et al.
5,333,204 A 7/1994 Hamada et al.
5,390,257 A 2/1995 Oslac et al.
5,402,503 A 3/1995 Prokisch
5,446,797 A 8/1995 Paddock
5,467,323 A 11/1995 Sone
5,471,437 A 11/1995 Schutter et al.
5,519,178 A 5/1996 Ritto et al.
5,524,151 A 6/1996 Bleim
5,548,657 A 8/1996 Fincham
5,583,945 A 12/1996 Iijima et al.
5,587,615 A 12/1996 Murray et al.
5,594,805 A 1/1997 Sakamoto et al.
5,604,815 A 2/1997 Paddock
5,617,477 A 4/1997 Boyden
5,625,688 A 4/1997 Ford et al.
5,625,699 A 4/1997 Yamada
5,625,701 A 4/1997 Scanlan
5,657,392 A 8/1997 Bouchard
5,715,324 A 2/1998 Tanabe et al.
5,715,775 A 2/1998 Anderson
5,744,761 A 4/1998 Ogura et al.
5,748,760 A 5/1998 Button
5,751,828 A 5/1998 Ueda et al.
5,802,189 A 9/1998 Blodget
5,802,191 A 9/1998 Guenther
5,835,612 A 11/1998 Fujihira et al.
5,847,333 A 12/1998 D'Hoogh
5,867,583 A 2/1999 Hazelwood et al.
5,894,524 A 4/1999 Kotsatos et al.
5,898,786 A 4/1999 Geisenberger
5,909,015 A 6/1999 Yamamoto et al.
5,909,499 A 6/1999 Tanabe
5,916,405 A 6/1999 Ritto et al.
5,917,922 A 6/1999 Kukurudza
5,937,076 A 8/1999 Tanabe et al.
5,960,095 A 9/1999 Chang
6,005,957 A 12/1999 Meeks
6,047,077 A 4/2000 Larsen
6,062,338 A 5/2000 Thompson
6,067,364 A 5/2000 Brinkley et al.
6,175,637 B1 1/2001 Fujihira et al.
6,176,345 B1 1/2001 Perkins et al.
6,208,743 B1 3/2001 Marten et al.
6,243,472 B1 6/2001 Bilan et al.
6,259,798 B1 7/2001 Perkins et al.
6,269,168 B1 7/2001 Tagami
6,292,573 B1 9/2001 Zurek et al.
6,343,128 B1 1/2002 Coffin
6,359,997 B2 3/2002 Geisenberger et al.
6,389,146 B1 5/2002 Croft, III
6,418,231 B1 7/2002 Carver
6,421,449 B1 7/2002 Hasegawa et al.
6,611,606 B2 8/2003 Guenther
6,654,476 B1 11/2003 Guenther
6,704,426 B2 3/2004 Croft, III
6,735,322 B1 5/2004 Watanabe
6,778,677 B2 8/2004 Coffin
6,876,752 B1 4/2005 Guenther
6,993,147 B2 1/2006 Guenther
7,006,653 B2 2/2006 Guenther
7,302,076 B2 11/2007 Guenther
7,532,737 B2 5/2009 Guenther
7,551,749 B2 6/2009 Rosen et al.
7,614,479 B2 11/2009 Plummer
7,633,208 B2 12/2009 Yamada et al.
7,653,208 B2 1/2010 Guenther
8,085,966 B2 12/2011 Amsel
8,189,840 B2 5/2012 Guenther
8,208,670 B2 6/2012 Wright
8,270,662 B2 9/2012 Guenther
8,526,660 B2 9/2013 Guenther
8,588,457 B2 11/2013 Guenther et al.
2001/0043715 A1 11/2001 Geisenberger et al.
2002/0090106 A1 7/2002 Guenther
2002/0150275 A1 10/2002 Guenther
2002/0196959 A1 12/2002 Gurner
2003/0015369 A1 1/2003 Sahyoun
2003/0031331 A1 2/2003 Harris et al.
2003/0044041 A1 3/2003 Guenther
2003/0123692 A1 7/2003 Ueki
2003/0228027 A1* 12/2003 Czerwinski ..... 381/342
2004/0071308 A1 4/2004 Guenther
2004/0076308 A1 4/2004 Guenther
2004/0161129 A1 8/2004 Guenther
2004/0165746 A1 8/2004 Kreitmeier et al.
2004/0231911 A1 11/2004 Welker et al.
2004/0258270 A1 12/2004 Shima
2005/0076644 A1 4/2005 Hardwicke et al.
2005/0087392 A1 4/2005 Flanders et al.
2005/0232456 A1 10/2005 Guenther
2006/0159301 A1 7/2006 Guenther
2006/0215870 A1 9/2006 Guenther
2006/0215872 A1 9/2006 Guenther
2006/0239492 A1 10/2006 Guenther
2006/0239493 A1 10/2006 Guenther
2007/0000720 A1 1/2007 Noro et al.
2007/0127760 A1 6/2007 Saiki et al.
2007/0201712 A1 8/2007 Saiki
2007/0230723 A1 10/2007 Hobson et al.
2007/0280499 A1 12/2007 Foletta
2008/0247582 A1 10/2008 Guenther
2008/0292117 A1 11/2008 Guenther
2009/0161902 A1 6/2009 Guenther
2009/0231960 A1 9/2009 Hutcheson
2009/0304222 A1 12/2009 Guenther
2010/0254564 A1 10/2010 Guenther

(56) References Cited

U.S. PATENT DOCUMENTS

| | | | |
|---|---|---|---|
| 2011/0002494 | A1 | 1/2011 | Opitz |
| 2011/0157694 | A1 | 6/2011 | Ferren et al. |
| 2011/0249824 | A1 | 10/2011 | Asada et al. |
| 2012/0328133 | A1 | 12/2012 | Guenther |
| 2013/0170689 | A1 | 7/2013 | Guenther |
| 2014/0044302 | A1 | 2/2014 | Guenther |
| 2014/0064541 | A1 | 3/2014 | Guenther |
| 2014/0334657 | A1 | 11/2014 | Guenther |

FOREIGN PATENT DOCUMENTS

| | | | |
|---|---|---|---|
| CN | 1439235 | A | 8/2003 |
| CN | 1443433 | A | 9/2003 |
| DE | 19725373 | A1 | 12/1998 |
| EP | 0 120 587 | A1 | 10/1984 |
| EP | 0 622 970 | A1 | 11/1994 |
| EP | 0 632 675 | A1 | 1/1995 |
| GB | 2 311 438 | A | 9/1997 |
| JP | 01-012795 | A | 1/1989 |
| JP | 10-210587 | A | 8/1998 |
| JP | 2000-138997 | A | 5/2000 |
| JP | 2004-502365 | A | 1/2004 |
| WO | 00/30405 | A1 | 5/2000 |
| WO | 01/13677 | A1 | 2/2001 |
| WO | 02/01913 | A1 | 1/2002 |
| WO | 02/01914 | A1 | 1/2002 |
| WO | 2006/029378 | A2 | 3/2006 |
| WO | 2013/100863 | A2 | 7/2013 |

OTHER PUBLICATIONS

Avilova et al., The Experimental Investigation of the Sound Insulation by Foam Shells. XIII Session of the Russian Acoustical Society. Aug. 25-29, 2003. p. 879-881.

Bosma et al., Heat transfer of metallic foam in thermoacoustic waves. University of Twente; The Netherlands. Division of Thermal Engineering, Department of Mechainical Engineering. Mar. 29, 2004.

Chinese Office Action sent to us Jan. 28, 2005 for Application No. 99815224.2 (2 Pages).

EP Search Report, EP Application No. 00954008.9, dated Mar. 25, 2009 (3 Pages).

Communication for European Patent Application No. 00954008.9, dated Mar. 29, 2010 (5 Pages).

EP Search Report, EP Application No. 05795118.8, dated May 6, 2010 (9 Pages).

Communication for European Patent Application No. 05795118.8, mailed Apr. 18, 2011 (5 Pages).

International Search Report for PCT/US99/27011, mailed Feb. 28, 2000 (1 Page).

International Search Report for PCT/US00/22119, mailed Nov. 14, 2000 (1 Page).

International Preliminary Examination Report for PCT/US00/22119, completed Aug. 6, 2002 (4 Pages).

International Search Report and Written Opinion mailed Sep. 28, 2006 for Application No. PCT/US2005/032308 (15 Pages).

International Preliminary Report on Patentability mailed Mar. 22, 2007 for Application No. PCT/US2005/032308 (10 Pages).

International Search Report and Written Opinion for Application No. PCT/US2012/48042 issued Oct. 10, 2012. (15 Pages).

Lu et al., Sound absorption in metallic foams. J appl Phys. Jun. 1, 1999;85(11):7528-39.

Sentura et al., Electronic circuits and applications. Massachusetts Institute of Technology, John Wiley & Sons, Inc., p. 22, 1975.

Srivastava et al., Metallic Foams: Current Status and Future Prospects. IIM Metal News. Aug. 2006;9(4):9-13.

Wang et al., Sound absorption of open celled aluminium foam fabricated by investment casting method. Mater Sci Technol. 2011;27(4):800-4.

Zhang et al., Acoustic Absorption Behaviour of the Compound Aluminum-Alleged Foam in Low Frequencies. IEEE. 2009. 4 pages.

Supplemental European Search Report for Application No. 01948816.2 issued Feb. 20, 2007 (3 Pages).

European Office Action for Application No. 01948816.2 issued Mar. 24, 2010 (5 Pages).

European Office Action for Application No. 01948817.0 issued Jan. 14, 2009 (5 Pages).

International Search Report for Application No. PCT/US01/20683 mailed Oct. 18, 2001 (1 page).

International Search Report and Written Opinion for Application No. PCT/US2014/037883, mailed Sep. 15, 2014 (16 pages).

* cited by examiner

200b

LOUDSPEAKERS AND SYSTEMS

This application is a continuation of U.S. patent application Ser. No. 12/693,982, filed Jan. 26, 2010, entitled "Loudspeakers And Systems," which is a continuation of U.S. patent application Ser. No. 11/223,214, filed Sep. 9, 2005, entitled "Loudspeakers And Systems," which issued as U.S. Pat. No. 7,653,208 on Jan. 26, 2010, which claims the benefit of U.S. Provisional Patent Application No. 60/608,755, filed Sep. 9, 2004, entitled "Loudspeakers And Systems." The teachings of all which the foregoing are incorporated herein by reference.

BACKGROUND OF THE INVENTION

The invention relates to sound reproduction and, in particular, provides improved loudspeakers, components and methods pertaining thereto. The invention has application, by way of non-limiting example, in sound reproduction of the type required by woofer and subwoofer drivers and loudspeakers.

A large percentage of loudspeakers used in audio systems are electrodynamic speakers. Such speakers employ a magnetic "motor" to produce movement of a cone-shaped diaphragm which, in turn, causes sound. The cone is typically disposed within a frame (or basket), with the wide end of the cone coupled to the frame by way of flexible membrane, called a suspension or surround, which axially centers the cone within the frame, yet, allows to move back and forth at audio frequencies. The narrow end of the cone is coupled to the frame by another flexible membrane, called a spider, which also helps to axially center the moving diaphragm.

The motor is made up of a voice coil, which is disposed (usually) behind the narrow end of the cone, and a magnetic circuit, which is disposed adjacent to and/or partially surrounding the coil. In operation, electrical audio signals from an amplifier (or other source) are applied to the voice coil, producing a varying electromagnetic field. This interacts with the magnetic field of the magnet circuit, causing the voice coil to move.

Because the voice coil is coupled to the diaphragm, its movement causes the diaphragm to pump in and out—explaining why the diaphragm and coil are sometimes referred to as a "piston." That, in turn, causes air around the speaker to pressurize and depressurize, producing sound waves. To prevent sound waves omitted from the rear of the diaphragm from canceling those emitted from the front, the speakers are usually mounted within an enclosure.

Traditionally, speakers are divided into three categories: woofer, midrange and tweeter. The woofer reproduces low frequency (bass) sound ranging from about 20 to 3000 Hz. The midrange speaker reproduces a broad spectrum of sound, typically from about 1000 Hz to 10 kHz. The tweeter speaker reproduces high frequency (treble) sound ranging from about 4 to 20 kHz. In home audio systems, the woofer, midrange and tweeter are often housed in a single enclosure, as in the case of free-standing or floor speaker configurations. Where space is a consideration, the functions of the woofer and midrange may be combined in a single speaker, as in the case with bookshelf-sized speaker configurations.

In the last few decades, a new category (or sub-category) of speaker had come to the fore, the sub-woofer. Though definitions vary, these are designed to reproduce sounds in the range of 20 to 150 Hz, i.e., in the low end of what was traditionally the woofer range. Subwoofers are finding increased use throughout the home. In home theater applications, their increased bass response lends to a more authentic movie theater-like feel. In computer applications, they provide, in addition to improved overall frequency response, a convenient location for housing amplification circuitry used by satellite speakers that provide mid- and high-range reproduction. In more traditional home stereo applications, subwoofers add increased punch and/or fidelity to many musical genre.

Subwoofers available today suffer from any number of shortcomings. Depending on design, they may be to boomy; suffer roll-off at the lowest frequencies; consume excessive power; produce an overly a "dry" sound; and/or be too large for practical use. Although the art has made strides toward minimizing these problems, there remains a need for a compact, low-cost, high fidelity loudspeaker that can be easily installed and operated.

An object of this invention is to provide such loudspeakers.

More generally, an object of the invention is to provide improved apparatus and methods for sound reproduction and, specifically, improved loudspeakers and systems.

Another object is to provide such loudspeakers and methods as are particularly suited for reproducing low frequency sounds, e.g., as low as 20 Hz (or lower), for use in home theater, high fidelity, computer and other applications.

A further object of the invention is to provide loudspeakers with desired response characteristics, yet, of minimal size.

Yet another object is to provide such loudspeakers that can be easily connected with receivers, amplifiers, computers or other sound-producing equipment.

Still another object is to provide such loudspeakers that can be easily and safely interconnected with existing power sources.

SUMMARY

The foregoing are among the objects attained by the invention which provides, in one aspect, an improved driver for use, for example, in loudspeakers as described below. The driver comprises a three-part piston having first and second diaphragms coupled back-to-back, with one of the diaphragms facing outward (i.e., toward the exterior of the loudspeaker enclosure) and the other diaphragm facing inward (i.e., into the interior of the enclosure). A voice coil that moves the piston is face-mounted (or front-mounted) within the inward-facing diaphragm. Together, the combination of the diaphragms and coil form a truss-like structure.

Drivers so constructed are flatter, or slimmer, than prior art constructions, yet, permit the same amount or more piston travel. This slimness facilitates implementations where space is a premium, e.g., panel (or flat) televisions, car audio, and wall-mounted subwoofers, to name a few. It also provides for improved tumble stability. Moreover, on account of this construction, the voice coil can be much larger than provided for in the prior art. This permits higher energy and greater thermal capacity and, as a result, the voice coil can drive heavy diaphragms that have low resonant frequencies within smaller enclosures.

According to a related aspect of the invention, such a three-part piston is disposed within a frame, supported by a pair of opposing surrounds—rather than by a combination of a surround and a spider (as is commonly used to support a diaphragm). Preferably those surrounds are identical or otherwise arranged so as to form a force-neutral, symmetrical, error-compensating suspension. This leads to lower distortion and better centering in mid-position for surer long-distance piston travel.

Further aspects of the invention provide loudspeakers that incorporate drivers, e.g., as described above, e.g., within enclosures or cabinets that have large passive radiators— thereby providing "moving wall speakers" that can be small and/or flat. One such loudspeaker has a cube-like enclosure with an electrodynamically-driven piston mounted in one external wall and movable panels in four other external walls. Those panels are air-coupled to the piston, e.g., via air within the enclosure, such that vibrational motion of the piston causes the vibration of the panels, thereby, improving the overall air coupling of the piston to the external environment, e.g., the listening room. In an alternate aspect, a driver as described above (or of alternate design) is enclosed within a flat or panel-like loudspeaker having a piston mounted in a front wall and one or more large passive radiators in a rear wall.

Another aspect of the invention provides loudspeakers as described above comprising the aforementioned truss-like driver mounted in the loudspeaker enclosure such that the first diaphragm (of the driver) has its face directed externally from one side of enclosure and the second diaphragm has its face directed externally from another side of the enclosure, with the voice coil disposed internally to the enclosure.

In a related aspect of the invention, the truss-like piston as described above is flush-mounted in a rear side wall of the aforementioned cubic enclosure. Portions of the top wall and of each of the three other side walls (front, left and right) are elastically suspended into their respective walls. Those portions (or panels, as referred to above) can comprise polycarbonate panels, or other materials of suitable acoustical characteristics. The walls into which those portions are suspended, e.g., via an overmolding process, can comprise steel or other materials providing necessary structural support. The suspension material, according to related aspects of the invention, comprises rubber or other materials of suitable elasticity and integrity.

By way of example, a cubic loudspeaker as described above can be sized to reproduce bass and/or or low-bass sounds, e.g., in the manner of a woofer or sub-woofer. As a subwoofer, for example, the loudspeaker can have an enclosure which is a 7" (18 cm) cube, or an approximately 4.5 liter box. The four moving panels, combined with the electrodynamically-driven piston, move external air in an amount equal to that of a 14" woofer—thus, providing the performance of a large woofer in a very small box.

According to a further related aspect of a driver of the type described above is arranged for mounting in a loudspeaker enclosure with the first diaphragm having its face (or front) directed externally from the enclosure, the second diaphragm having its face (or front) directed internally into the enclosure, and the voice coil disposed internally to the enclosure. In one practice of the invention, that enclosure is of the type described above, with the driver (flush-mounted) on a first external side wall and with the moveable panels elastically mounted in four (or fewer) of the other external walls and air-coupled to the driver's internally-directed diaphragm via air internal to the enclosure.

Continuing the above example, the air-coupled walls of a seven cubic-inch woofer or subwoofer as described above can be powered by such a driver, e.g., if it has an extreme-energy long-stroke flat piston woofer. The driver's dual opposed surrounds enable a long stroke (e.g., of 1.25", or otherwise) and, as noted, form a stable force-neutral highly symmetrical error compensating suspension. With a 2.6" (65.5 mm) voice coil, by way of example, such a woofer or sub-woofer can handle large amounts of short-term power.

Such large powerful coil in a small woofer is possible, because the area normally occupied by a centering spider is now available for the installation of a magnetic circuit. This permits a subwoofer that can be tuned to 25 Hz by optimally aligning all moving masses, springs and damping. It can achieve sound pressures of more than 105 dB @ 1 m and 36 Hz, e.g., given 1000 W of drive power.

In a further aspect of the invention, that magnetic circuit is an extreme-energy dual neodymium magnet circuit, e.g., of the type described by this inventor hereof in U.S. Pat. No. 5,802,191. That circuit includes a pair of stacked magnetic members, preferably comprising neodymium boron, that are stacked on top of one another, 180° out of phase (i.e., such that the "north" poles are adjacent one another) and that are separated by a top plate and/or pole piece.

Still further aspects of the invention provide a loudspeaker as described above in which galvanic connection is provided between line power and an on-board amplifier. This is a direct benefit of the dual rubber suspension design, which provides complete UL, and VDE-compliant electrical line isolation in case of coil or amplifier failure while eliminating the need for—as well as the cost, size and weight of—a separate power supply. Electrical isolation of the voice coil and magnet from the front of the loudspeaker and its enclosure is further insured by use, according to some practices of the invention, of a frame and/or other mounting members that are constructed from polycarbonate, acrylonitrile butadiene styrene (ABS) or other insulative material. Use of an audio input that is opto-coupled or wirelessly coupled (e.g., via Bluetooth or otherwise) to the loudspeaker further insures electrical isolation.

Related aspects of the invention provide loudspeakers as described above in which digital audio input is supplied via a wireless microwave link, facilitating installation and improving line isolation. That link can be via Bluetooth, 802.11x, Home-plug, or otherwise. Regardless, these links can be bi-directional and permit optional room acoustic or woofer servo controls.

These and other aspects of the invention are evident in the drawings and in the description that follows.

BRIEF DESCRIPTION OF THE DRAWINGS

A further understanding of the invention may be attained by reference to the drawings, in which.

DETAILED DESCRIPTION OF THE ILLUSTRATED EMBODIMENT

The invention provides speakers, drivers and fabrications therefor with improved footprint (e.g., flat-panel), sound fidelity and/or usability, among other things, as evident in the sections that follow.

Figure 1A:
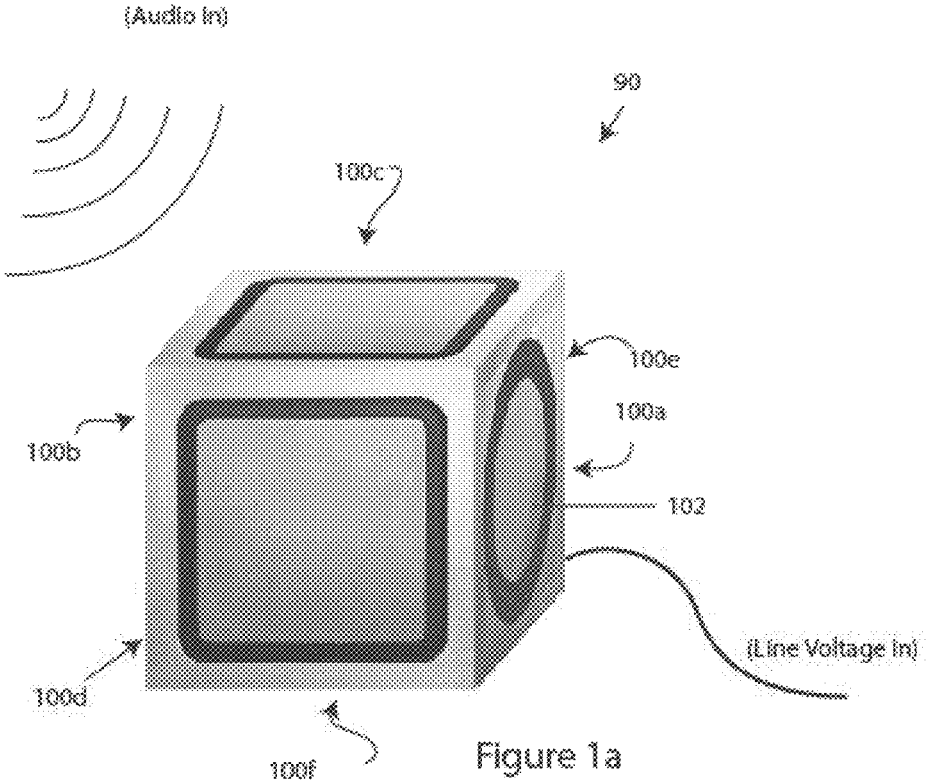
FIG. 1A is an external perspective view of a cubic loudspeaker according to one practice of the invention.
Figure 1B:
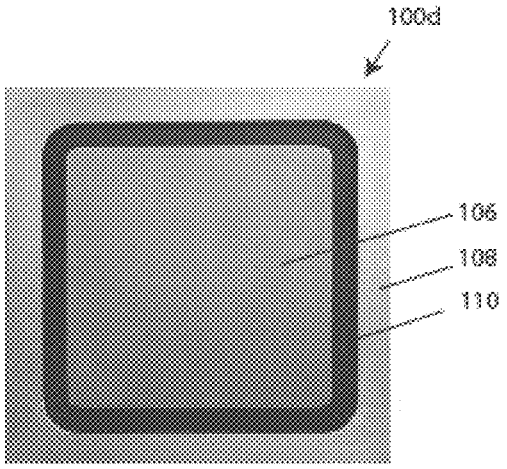
FIGS. 1B and 1C are views of back and side walls, respectively of the loudspeaker of FIG. 1A.

FIG. 1A is an external perspective view of a loudspeaker 90 according to one practice of the invention. The cube-shaped device 90 comprises an enclosure 100 having a piston 102 mounted in one external wall, e.g., back wall 100*a*. That wall is separately depicted in FIG. 1B, showing the piston diaphragm 103 and the surround 104 via which it is retained in a frame (see FIG. 2). In the illustrated embodiment, the diaphragm is flush-mounted with the wall 100*a*, though, in other embodiments it may be recessed or otherwise.

Four of the other walls, namely, front 100*b*, top 100*c*, right side 100*d*, and left side 100*e*, have centrally disposed panels or portions that are elastically mounted to the enclosure (and, specifically, to the perimeter portions of the respective walls) and that are air-coupled to the piston 102 via air within the enclosure 100. One of those other walls, namely, right side 100*d*, is separately depicted in FIG. 1B. In that drawing, the central portion is labelled 106, the perimeter portion is labelled 108 and the elastic portion used to suspend the former within the latter is labelled 110.

Though four walls 100*b*-100*e* of the illustrated embodiment have elastically mounted central portions for improving the air coupling of the piston 102 to the external environment (e.g., a listening room in which the loudspeaker 90 is placed), other embodiments may have greater or fewer walls so arranged. Moreover, although the illustrated embodiment is cubic, it will be appreciated that other volumetric shapes may be used instead.

In the illustrated embodiment, the enclosure 100 and, specifically, bottom wall 100*f* and perimeter portions of walls 100*a*-100*e* are comprised of steel panels, though, materials of suitable rigidity, weight and acoustic properties can be used instead or in addition. The central portions of walls 100*b*-100*e* comprise polycarbonate, though, again, other materials (such as steel or other metal, acrylonitrile butadiene styrene (ABS), and so forth), of suitable rigidity, weight and acoustic properties can be used instead or in addition. The elastomeric material used to mount/suspend the central portions of walls 100*b*-100*e* to their respective perimeter portions can comprise rubber or other material of suitable elasticity and acoustic properties.

In the illustrated embodiment, the walls 100*b*-100*e* are fabricated by overmolding polycarbonate central portions (or central portions comprised of ABS or other materials of suitable properties) into steel perimeter portions using synthetic rubbers or other elastomers. Preferred such compounds are thermoplastic elastomers (TPEs), such as, by way of non-limiting example, thermoplastic urethane (TPU), thermoplastic vinyl (TVP), poly(styrene)-poly(ethylene,butylene)-poly(styrene) (SEBS), and so forth, though it will be appreciated that other elastomers can be used instead or in addition—indeed, even real rubber could be used, though, present-day overmolding techniques are not adapted for this. One preferred TPV, which can be used with conventional overmolding, is sold under the tradename Uniprene® by Teknor Apex, though, competing products may be used instead.

The overmolding process utilized in the illustrated embodiment forms each panel 100*b*-100*e* from the aforementioned polycarbonate, steel and TPE substituents on a single molding machine. This is accomplished by forming a small hole in each steel perimeter portion and injecting the TPE to the opposite side, where it fuses the polycarbonate central portion of that opposite side to the steel perimeter portion of that side. Of course, it will be appreciated that other overmolding techniques can be used instead and, additionally, that techniques other than overmolding can be used to fabricate the walls 100*b*-100*e*.

Illustrated loudspeaker 90 is sized to reproduce bass and/or or low-bass sounds, e.g., in the manner of a woofer or subwoofer, respectively. In one embodiment, the loudspeaker is configured as a subwoofer with an enclosure 100 defining a 7" (18 cm) cube, or an approximately 4.5 liter box. The four walls 100*b*-100*e* with moving central panels, combined with the piston 102, move external air in an amount equal to that of a 14" woofer—thus, providing the performance of a large woofer in a very small box.

More specifically, an advantage of walls 100*b*-100*e* constructed as above is that stetching of the elastomer is minimized due to the relatively large surface of the radiating panels formed by the central portions of those walls. In an enclosure of that comprises an 8" cube, these provide an overall surface area that is three to four times greater surface area than a conventional active speaker, so panel travel is limited and suitable to 115 dB sound pressure level (again, from an 8" cube). This results in a low cost solution with a slim footprint—since, the travel of the panels is limited to a few millimeters, because of the large panel area(s) is driven by a small active piston of long travel capability, as detailed below.

Line power, routed via cable 110, supplies an amplifier (not shown) that is preferably internal to the loudspeaker enclosure. That amplifier can be of a conventional variety known in the art. That of the illustrated embodiment is designed to supply 1000 Watts of digital audio power, though amplifiers of other sizes may be used in addition or instead. Galvanic connection is utilized between line power and an on-board amplifier. This is a direct benefit of the dual rubber suspension design, which provides complete UL, and VDE—compliant electrical line isolation in case of coil or amplifier failure while eliminating the entire kilowatt power supply.

Audio input to the loudspeaker are supplied via a wireless link 112, facilitating installation, improving line isolation, and insuring electrical isolation of the internal line voltage-coupled power circuitry. That link can be Bluetooth, 802.11x, Home-plug, or otherwise. Opto-coupling can be used instead or in addition. In addition to supporting the transfer of audio information, e.g., from a receiver, amplifier or other audio device, to the loudspeaker 100, the link 112 can support acoustic control signals (e.g., loudness, on/off, etc.). In addition it can be bi-directional and/or facilitate control of acoustics or woofer servos.

Figure 2:
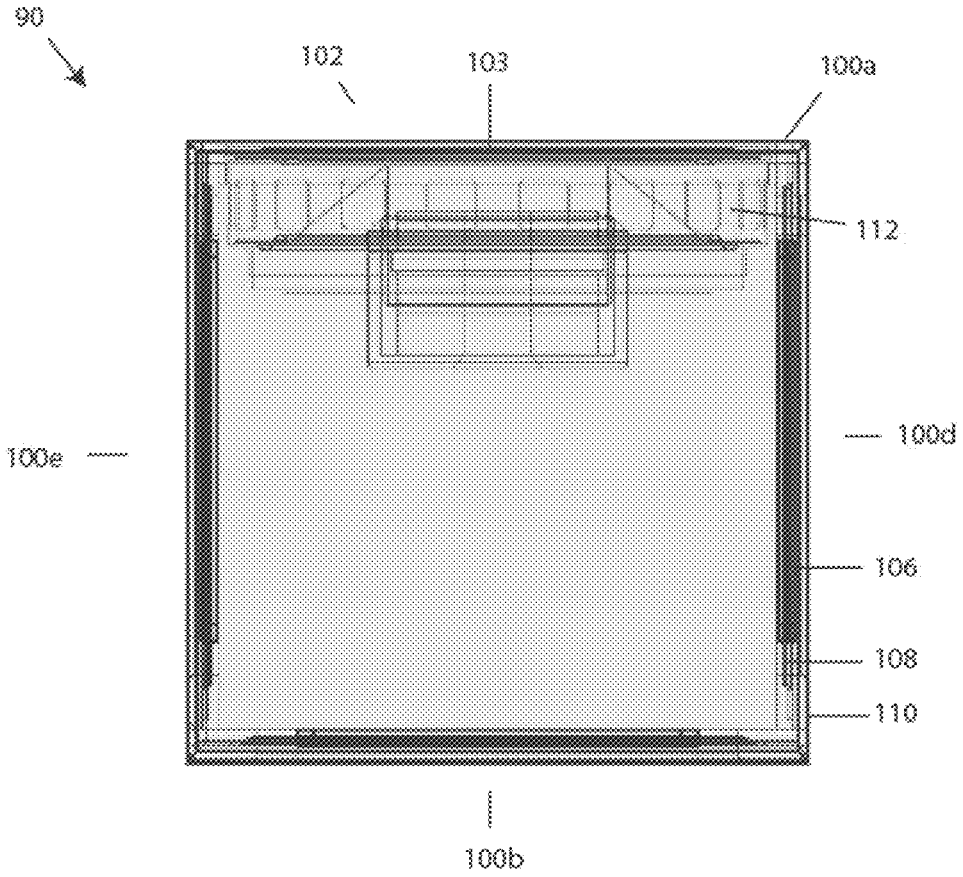
FIG. 2 is a top cross-sectional view of a loudspeaker according to one practice of the invention.

FIG. 2 depicts the loudspeaker 100 in a cross-sectional view from the top. As shown in the drawing, piston 102 is mounted in back wall 100*a* via frame 112. Also shown in the drawing are the elastically mounted panels that are disposed in side walls in front 100*b*, top 100*c*, right side 100*d*, and left side 100*e*.

Figure 3A:
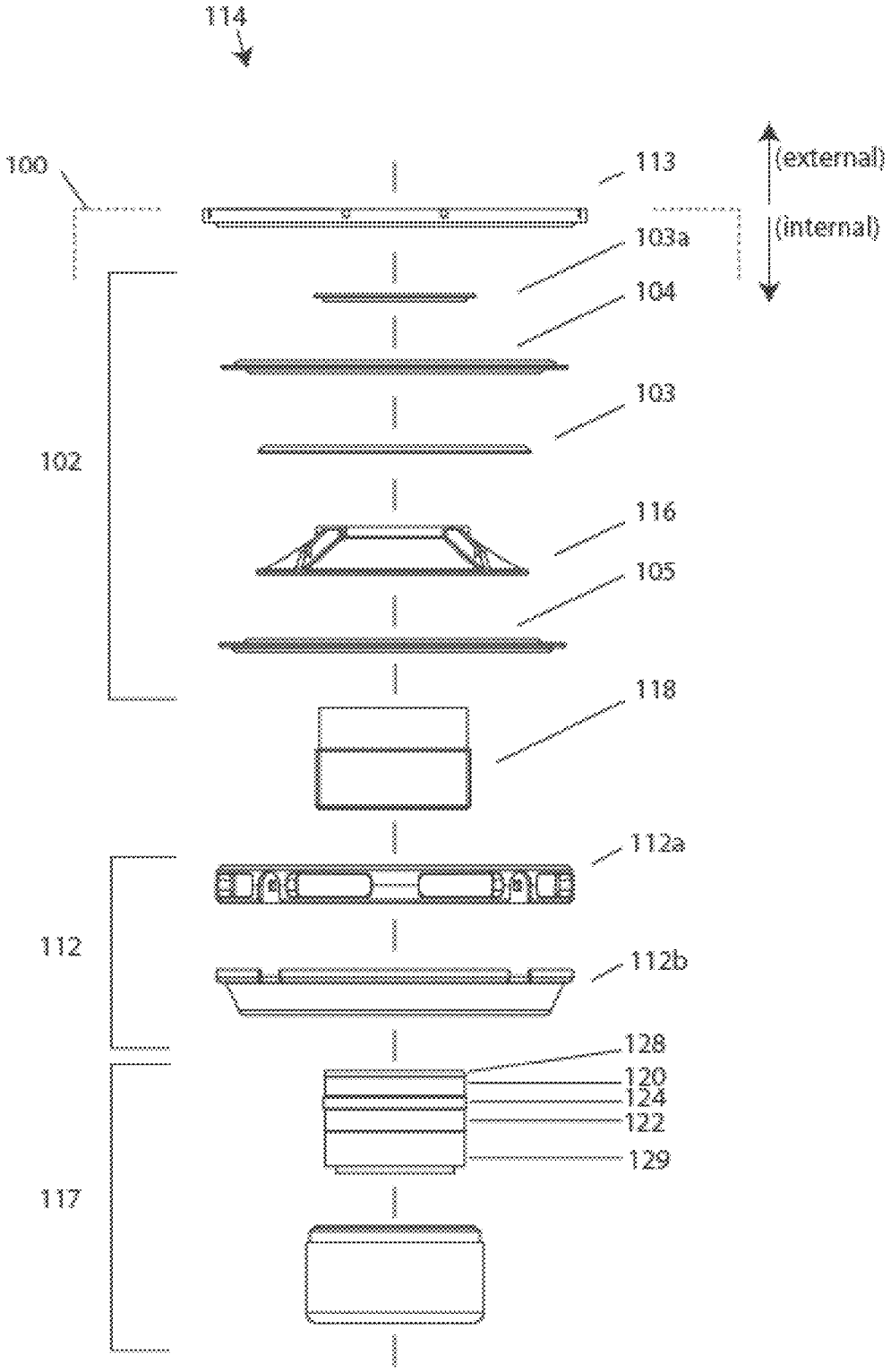
FIGS. 3A-3D depict a driver according to one practice of the invention.

FIG. 3A is an exploded view of a speaker or driver 114 according to one practice of the invention comprising piston 102, frame 112, baffle 113, and magnetic circuit 117. Piston 102 comprises first diaphragm 103 and second diaphragm 116 coupled back-to-back, as shown, with the face of the first diaphragm 103 facing externally vis-a-vis the enclosure 100 and the face of second diaphragm 116 facing internally vis-a-vis that enclosure. A voice coil 118 is mounted internally in the face of the second diaphragm, as shown. As more plainly evident in FIG. 3B, together, the combination of the diaphragms and coil can be seen to form a truss-like structure.

In the illustrated embodiment, diaphragm 103 is flat or substantially flat, although other embodiments may use cone-shaped, dome-shaped, or diaphragms of other shapes. Likewise, in the illustrated embodiment, diaphragm 116 is cone-shaped, although other embodiments may use diaphragms of other shapes. These diaphragms 103, 116 can fabricated from cloth, plastics, composites or other conventional materials known in the art loudspeaker design; however, in a preferred embodiment diaphragm 103 comprises metal, e.g., like the elastically-mounted central portions of loudspeakers walls 100*b*-100*e*, discussed above. In the illustrated embodiment, a dustcap 103*a* occupies a central portion of diaphragm 103, which is annularly shaped. That dustcap 103*a* can be fabricated from the same material as the diaphragm 103, or otherwise, and is preferably interference-fit and secured (e.g., via adhesives, welds, or otherwise) thereto. In embodiments that do not incorporate a dustcap, the diaphragm 103 is preferably fabricated as a solid disk, not an annulus.

Figure 3B:
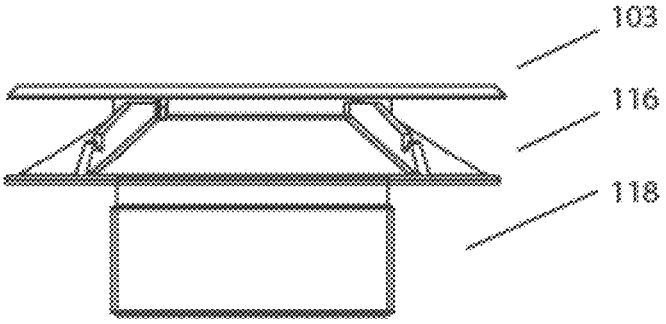

As further shown in FIGS. 3A-3B, the piston 102 is disposed within a-frame 112 and baffle 113 (which, themselves, are disposed within the enclosure 100) supported by opposing rubber (or other elastomeric) surrounds 104, 105, as shown. Preferably those surrounds are identical or otherwise arranged so as to form a force-neutral, symmetrical, error-compensating suspension.

The foregoing contrasts with the prior art use of a single surround and a spider to retain a cone diaphragm. In such (prior art) configurations, travel of the diaphragm is limited by the spider, corrugations in which must increasingly unfold as the voice coil moves the diaphragm further from its (and the spider's) resting position. Longer travel requires more corrugations which, in turn, requires a larger spider. However, longer travel also requires a larger voice coil (and magnetic circuit). Since, the space occupied by the voice coil and spider overlap—in prior art configurations—both cannot be large. Hence, diaphragm travel is unduly limited.

The driver 114 overcomes this limitation. The truss-like diaphragm/coil structure and the dual roll surrounds enable much larger piston travel (e.g., 1.25" in the illustrated embodiment). The compensating forces exerted by the dual roll surrounds, moreover, facilitate diaphragm motion that ensures precise audio reproduction.

Turning back to the drawing, frame 112 of the illustrated embodiment comprises to members a cylindrical ring 112*a* and a cone-shaped basket 112*b*. Ring 112*a* holds retains surrounds 104, 105, securing it within the enclosure. Basket 112 likewise retains the magnetic circuit 115 and secures it, too, within the enclosure. Although the frame is comprises two parts in the illustrated embodiment, in other embodiments it comprises a single, larger cone-shaped member. Regardless, the frame 112 member(s) can be steel or other metals, though preferably, they are polycarbonate, ABS, or other insulative materials of suitable weight, strength and acoustic properties. As noted elsewhere herein, the use of insulative materials better insures electrical isolation of the loudspeaker's exterior from the power supply.

Baffle 113 provides fit and finish for the assembled loudspeaker, securing the frame to the corresponding wall 100 of the enclosure and sealing any gaps therebetween. It can be comprised of the aforementioned materials (e.g., steel, polycarbonate, ABS, etc.) or other materials of suitable weight, strength and acoustic properties.

Figure 3C:
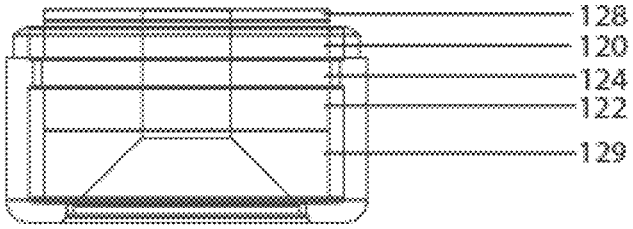

The piston 102 is driven by a dual neodymium magnetic circuit 115 of the type generally described by the inventor hereof in U.S. Pat. No. 5,802,191, entitled "Loudspeakers, Systems, and Components Thereof," the teachings of which are incorporated herein by reference (see, by way of non-limiting example, the discussion of magnet driver 74 at column 5, lines 32-44, of the incorporated-by-reference patent and the accompanying illustration). Referring to FIGS. 3A and 3C, that circuit includes a pair of stacked magnetic members 120, 122, preferably comprising neodymium boron, that are stacked on top of one another and 180° out of phase (i.e., such that the "north" poles are adjacent one another) and that are separated by a top plate or pole piece 124, as shown.

A further top plate (or turbo plate) 128 and a magnetic plug 129 are provided at the distal ends of the stacked assembly, as shown. These serve to concentrate and focus the magnetic flux within a gap formed between a shell 126 and the sandwiched magnet-plate assembly (comprising elements 120, 122, 124, 128 and 129). It is within that gap that the voice coil resides, with the plates focusing the flux, e.g., as generally described by the inventor hereof in U.S. patent application Ser. No. 09/895,003, entitled "Low Profile Speaker and System," the teachings of which are incorporated herein by reference (see, by way of example, the magnetic structure 30' in FIG. 2 of the incorporated-by-reference application and the corresponding text at page 6, lines 8, et seq.).

Figure 3D:
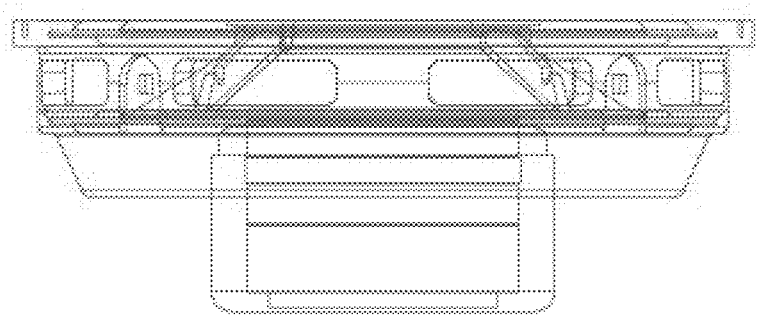

FIG. 3D depicts the loudspeaker as fully assembled, e.g., for assembly and use within the enclosure 100. For simplification, the voice coil 118 is not shown in this drawing.

Figure 1C:
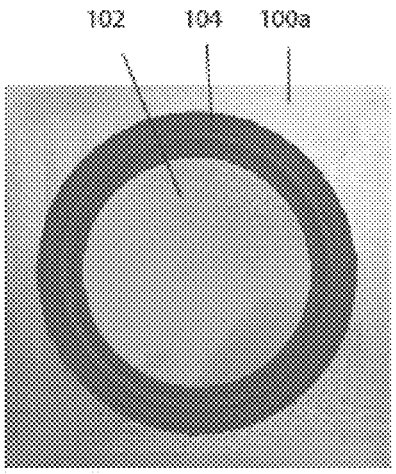

When embodied in a seven cubic-inch woofer of sub-woofer of the type shown in FIGS. 1 and 2, the driver's dual roll surrounds 104, 105 enable a long stroke (e.g., of 1.25", or otherwise) and, as noted, form a stable force-neutral highly symmetrical error compensating suspension. With its 2.6" (65.5 mm) voice coil, by way of example, such a woofer or sub-woofer can handle large amounts of short-term power. Such large powerful coil in a small woofer is possible, because the area normally occupied by a centering spider is now available for the installation of a magnetic circuit. This permits a subwoofer that can be tuned to 25 Hz by optimally aligning all moving masses, springs and damping. It can achieve sound pressures of more than 105 dB @ 1 m and 36 Hz, e.g., given 1000 W of drive power.

A driver constructed as discussed above can be built much slimmer than conventional drivers because the magnet circuit 117 nests partially inside the plane that normally is occupied by the spider. Combining that with the enclosure wall construction discussed above permits fabrication of the flattest speaker for any given excursion with low extended frequency response, assuming there is enough magnetic and electric forces to displace the moving masses. The illustrated embodiment provides both. One, by virtue of the extreme magnetic energy of the dual neodymium magnet; the other, by use of a low cost off-line digital half bridge amplifier powered at 1,000 W @8 Ohms. The air volume of the enclosure serves as a highly effective coupling medium between the moving components—unlike conventional speakers, in which the enclosed air volume that gets compressed or rarified.

FIGS. 4A-4D depict a loudspeaker 190 according to another practice of the invention. The device 190 is constructed and operated as described above, with respect to loudspeaker 90, except insofar as shown in FIGS. 4A-4D and discussed below. Thus, apart from stand 192, the loudspeaker 190 comprises an enclosure 192 that is generally "flat" or panel-like in shape, i.e., with a length and/or height that exceeds its depth. In this regard, the enclosure (or one of generally similar configuration) is suitable for use with "panel" televisions, car stereo, wall-mounted or in-wall speakers, and other configurations where slim footprint is desired.

As with speaker 90, loudspeaker 190 has a driver 202 mounted in one external wall, e.g., front 200*a*. That driver can be constructed in manner of driver 114, discussed above and shown in FIGS. 3A-3D. However, in the illustrated embodiment, a driver more conventional design is utilized, as illustrated. Unlike conventional prior art drivers, the driver of illustrated speaker 190 preferably has a magnetic circuit of the type described by the inventor hereof in incorporated-by-reference U.S. Pat. No. 5,802,191, entitled "Loudspeakers, Systems, and Components Thereof" (see, by way of non-limiting example, the discussion of magnet driver 74 at column 5, lines 32-44, of the incorporated-by-reference patent and the accompanying illustration) and U.S. patent application Ser. No. 09/895,003, entitled "Low Profile Speaker and System" (see, by way of example, the magnetic structure 30' in FIG. 2 of the incorporated-by-reference application and the corresponding text at page 6, lines 8, et seq.), as described above—albeit in a behind-the-cone (or rear-mounted configuration), as shown—in order to achieve increased efficiency and audio power.

Figure 4A:
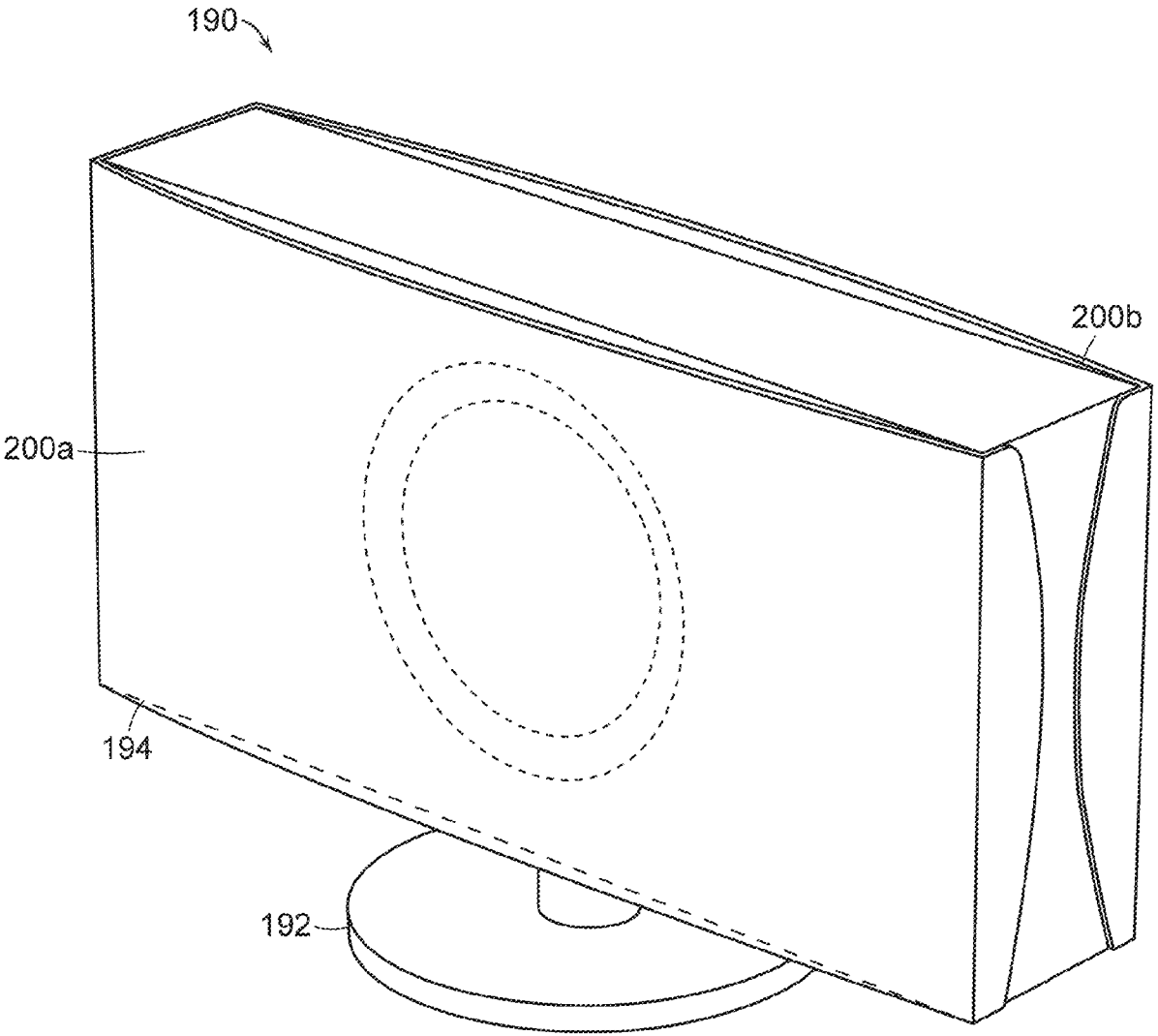
FIGS. 4A-4C depict a flat loudspeaker according to a further practice of the invention.
Figure 4B:
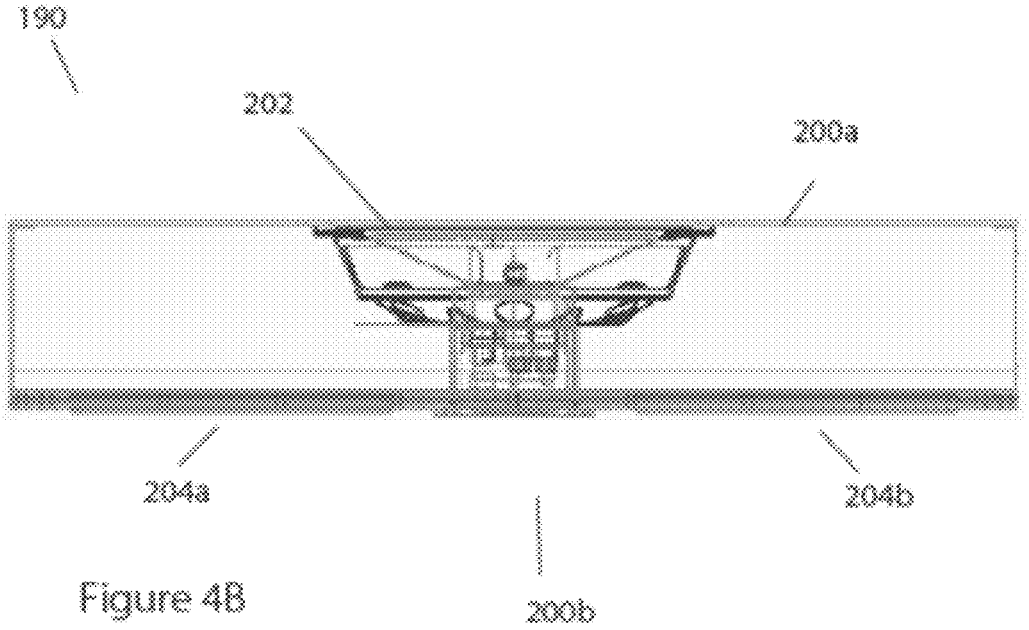

Referring to FIG. 4B, the back wall 200*b* of illustrated speaker 190 includes panels or portions that are elastically mounted to the enclosure in the same matter as the centrally disposed panels of loudspeaker 90, described above. Speaker 190 can utilize one such panel in back wall 200*b*. However, in the illustrated embodiment, it utilizes two such panels 204*a*, 204*b*. These are disposed on opposing sides of a mount 206 that secures the back side of driver 202, as illustrated, and that accommodates wiring, user controls and the like, thereof.

Figure 4C:
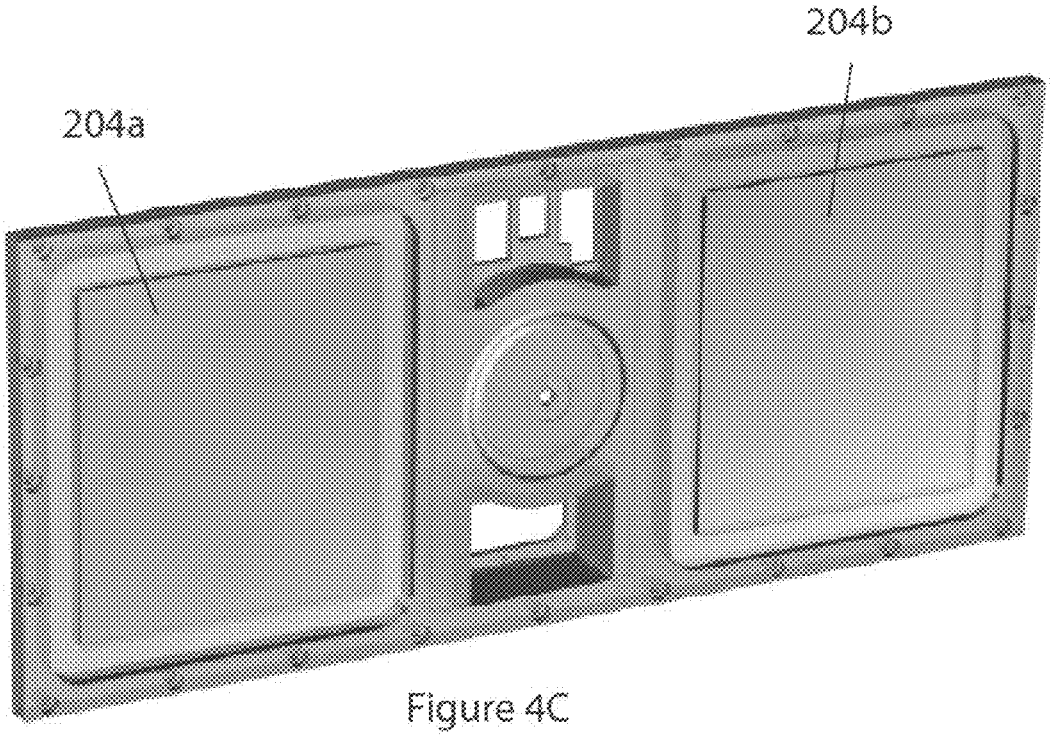

As above, the enclosure walls (including walls 200*a*, 200*b*) of loudspeaker 190 are comprised of steel, though, materials of suitable rigidity, weight and acoustic properties can be used instead or in addition. The panels 204*a*, 204*b* comprise polycarbonate, though, again, other materials (such as steel or other metal, ABS, and so forth), of suitable rigidity, weight and acoustic properties can be used instead or in addition. And, as above, the elastomeric material used to mount/suspend the central portions of walls 100*b*-100*e* to their respective perimeter portions can comprise rubber or other material of suitable elasticity and acoustic properties. Moreover, as above, wall 200*b* can be fabricated by overmolding polycarbonate central portions (or central portions comprised of ABS or other materials of suitable properties) into steel perimeter portions using synthetic rubbers or other elastomers, or by other techniques discussed or alluded to above. FIG. 4C depicts the back wall 200*b* of speaker 190, specifically highlighting panels 204*a* and 204*b*.

Described above and shown in the drawings are loudspeakers and drivers that achieve the objects of the invention, and more. As evident in the discussion above, among the unique features of those loudspeakers and drivers are:

Unlike the prior art, drivers according to the invention employ two surrounds instead of one surround and a spider. As noted above, the surrounds can (though they need not) be identical and can be coupled back-to-back as in the illustrated embodiment, for motional symmetry. This leads to lower distortion and better centering in mid-position for surer long-distance piston travel.

The voice coil and magnetic circuit positioned inside the reverse (or inward-facing) cone or diaphragm, forming a truss-like structure that is 35% flatter, or slimmer, than prior art constructions, yet, permits the same amount of piston travel. Slimness facilitates implementations where space is a premium, e.g., panel (or flat) televisions, car audio, and wall-mounted subwoofers, to name a few. This configuration also improves tumble stability due to larger moment of inertia.

Due to the above construction, the voice coil can be much larger than provided for in the prior art: e.g., 65.5 mm (as discussed above) versus 25 mm (common to prior art). This permits higher energy ($BL^2/Re$) and greater thermal capacity. As a result, the voice coil can drive heavy cones (or diaphragms), e.g., of the type described above, for low resonant frequency ($F_o$), permitting smaller enclosures. For example, in the cubic loudspeaker described above, an enclosure under 5 liter provides a system with $F_o$=32 Hz. Moreover, the size of outward-facing diaphragm can be scaled over wide range of diameters without taller enclosure. The discussion above, for example, utilizes a diaphragm of 6-inch diameter in a 7-cubic inch enclosure. However, an enclosure of same configuration and not much greater height can support an 8" or 10" diaphragm. With larger diameters, surrounds can (but need not) be different. Utilizing back-to-back geometry, as discussed above, retains high degree of motional symmetry.

Air-coupling, via the loudspeaker cabinet, of powerful drivers as described above with large passive radiators disposed in cabinet walls provides "moving wall speakers" that can be both small and/or flat.

The voice coil and magnet are electrically isolated from the front of the loudspeaker and its enclosure (or cabinet) by way of a frame, baffle or other mounting members constructed from polycarbonate, ABS or other insulative material. This permits use of a direct alternating current (a/c) internal amplifier and, thereby, eliminates the cost, bulk and waste of a separate power supply. For example, as noted above, in the illustrated embodiment an 8-ohm voice coil achieves 1000 W with half bridge class D amplifier. This lowers cost, size and weight of the loudspeaker. Opto-coupling or wireless coupling (e.g., via Bluetooth or otherwise) of the audio input also insures isolation from internal amplifier, as does use of non-conductive frame members.

Those skilled in the art will appreciate that the embodiments disclosed herein are merely examples of the invention and that other embodiments, incorporating changes thereto, fall within the scope of the invention, of which I claim:

1. A flat or panel-like loudspeaker comprising
an enclosure,
a piston mounted in one external wall of the enclosure,
a first passive panel elastically mounted in a first other external wall of the enclosure and air-coupled to the piston,
a second passive panel elastically mounted in a second other external wall of the enclosure and air-coupled to the piston, where the second other external wall of the enclosure is disposed on an opposite side of the enclosure from the first other external wall, and
a third passive panel elastically mounted in a third other external wall of the enclosure and air-coupled to the piston.

2. A loudspeaker according to claim 1, wherein audio input is wirelessly or optically coupled to amplification circuitry within the enclosure.

3. A loudspeaker according to claim 2 that includes a line-voltage amplifier within the enclosure.

4. A loudspeaker comprising
an enclosure,
a piston mounted in one external wall of the enclosure,
three or more panels, each elastically mounted in a respective one of each of three or more other external walls of the enclosure and each air-coupled to the piston.

5. The loudspeaker according to claim 4, wherein the enclosure is cube-shaped.

6. The loudspeaker according to claim 4, wherein a panel is elastically mounted to each of four external walls of the enclosure other than the wall in which the piston is mounted.

7. The loudspeaker of claim 4, wherein at least one of the panels is elastically suspended in its respective external wall.

8. A loudspeaker comprising
an enclosure,
a driver mounted in one external wall of the enclosure, the driver comprising
a piston having first and second diaphragms coupled back-to-back with one another,
a voice coil within the second diaphragm, and two or more panels, each elastically mounted in each of one or more other external walls of the enclosure and each air-coupled to the piston.

9. The loudspeaker of claim 8, wherein the piston is disposed within a frame and wherein the each of the diaphragms is supported by an elastomeric surround.

10. The loudspeaker of claim 8, comprising a wireless audio input.

11. The loudspeaker of claim 10, comprising an amplifier that is galvanically coupled to line power.

12. The loudspeaker of claim 8, wherein at least two of the two or more panels are mounted on opposite walls of the enclosure.

* * * * *